US008857751B1

(12) United States Patent
Armstrong et al.

(10) Patent No.: US 8,857,751 B1
(45) Date of Patent: Oct. 14, 2014

(54) COLLECTION AND DEPLOYMENT DEVICE

(76) Inventors: Lance J. Armstrong, Raceland, LA (US); Brett Hebert, Lafayette, LA (US)

( * ) Notice: Subject to any disclaimer, the term of this patent is extended or adjusted under 35 U.S.C. 154(b) by 185 days.

(21) Appl. No.: 13/293,989

(22) Filed: Nov. 10, 2011

(51) Int. Cl.
*B65H 75/40* (2006.01)

(52) U.S. Cl.
USPC ..... 242/391; 242/391.1; 242/397.1; 242/611.1

(58) Field of Classification Search
USPC ..... 242/389, 391, 391.1, 395, 397.1, 403.1, 242/406, 611.1, 611.2, 613
See application file for complete search history.

(56) References Cited

U.S. PATENT DOCUMENTS 1,990,860 A * 2/1935 Ellsworth ..... 242/613
2,685,419 A * 8/1954 Helberg ..... 242/388.1
2,917,253 A * 12/1959 Way ..... 242/391
3,680,807 A * 8/1972 Fortson ..... 242/391
4,056,241 A * 11/1977 Yates ..... 242/391
7,484,684 B2 * 2/2009 Saavedra et al. ..... 242/391

* cited by examiner

*Primary Examiner* — Sang Kim
(74) *Attorney, Agent, or Firm* — Raymond G. Areaux; Emily L. Gordy; Carver, Darden, Koretzky, Tessier, Finn, Blossman & Areaux, LLC

(57) ABSTRACT

A device for collecting, storing and deploying inflatable slides and play structures. In general, the device comprises an elongated barrel, an end cap immediately adjacent to each end of the elongated barrel, a ratchet device removably connected to each end of the elongated barrel, a handle connected to each ratchet device, and a slot running along the length of the elongated barrel. The device is used to collect an inflatable by attaching ratchet devices which are attached to handles to each end of the elongated barrel, inserting a portion of an inflatable into the slot of the elongated barrel; and alternatively pulling and pushing each handle to incrementally wind the inflatable around the elongated barrel.

36 Claims, 8 Drawing Sheets

FIG. 1
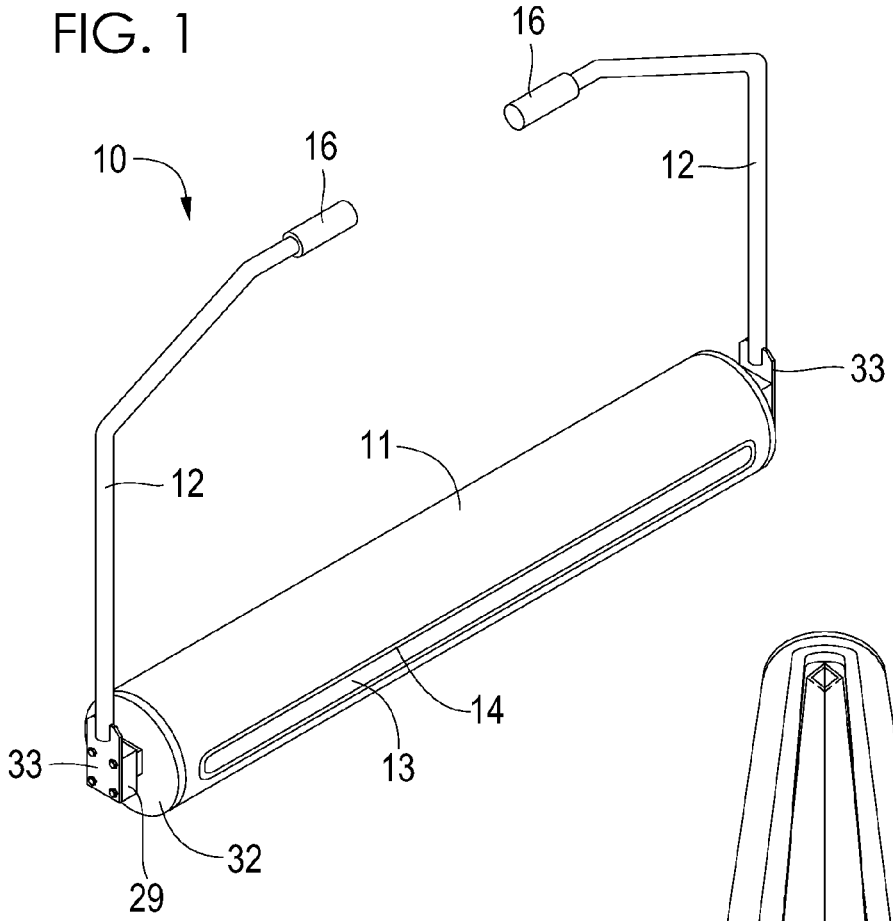
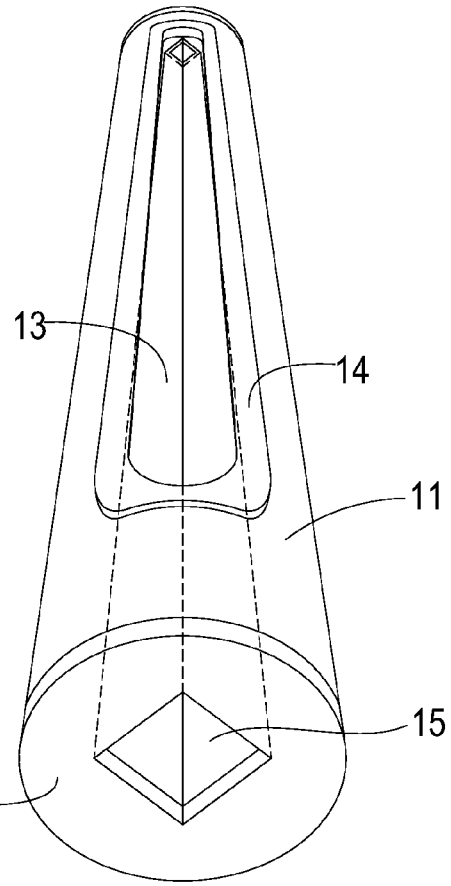
FIG. 2

COLLECTION AND DEPLOYMENT DEVICE

BACKGROUND OF THE INVENTION

I. Field

The present invention relates to a device for collecting, storing and deploying inflatable slides and play structures.

II. Background

Inflatables, such as inflatable slides and play structures, are air-inflated devices that are typically used for children's amusement. Inflatables are usually erected for short periods of time, and not left up permanently. In preparing an inflatable for use, the slide or structure is laid out at the desired location, and then blowers are used, along with aid from the person deploying the inflatable, to inflate the slide or structure and to maintain inflation during use. After the inflatable is no longer being used, and it is desired for the inflatable to be taken down, the blowers are turned off and, along with aid from the person collecting the inflatable, the inflatable deflates. Once deflation is complete, the inflatable is collected and stored until the next use. Because inflatables are generally used only for short periods of time, the process of deploying, inflating, deflating, collecting, and storing the inflatable is repeated many times during the life of the inflatable.

Inflatables are often quite large, and thus are bulky and heavy even when deflated. As such, the collection and deployment of inflatables can be quite burdensome. Thus, there is a need for a device to collect and deploy inflatables in a less onerous manner. Additionally, it is not uncommon for water to be used to cover the inflatable's surface during the use of the inflatable. However, in order to preserve the integrity of the inflatable, it is advisable to remove any water from the surface of the inflatable before storage. This water removal step creates an additional obstacle in collecting the inflatable. Accordingly, there is a need for a collection device that will remove much or all of the water from the inflatable during the course of collection.

Furthermore, in many instances a company will own multiple inflatables which it rents out to users. Thus, it is beneficial for the inflatables to be collected and stored in a manner that allows the inflatables to be stacked or otherwise stored in an organized fashion. Thus, there is a need for a device that allows the inflatable to be collected so that it results in a compact, uniform shape for ease of storage.

SUMMARY OF THE INVENTION

In view of the aforementioned problems, it is an object of the present invention to provide a collection and deployment device for collecting and deploying inflatables, tents, tarps, signs, awnings or other similar objects. The device comprises an elongated barrel with a slot, end caps immediately adjacent to the ends of the elongated barrel, ratchet devices removably connected the end caps, and handles connected the ratchet devices.

The present invention also contemplates a method of using the device to collect an inflatable. To use the device to collect the inflatable, a user inserts a first end of a ratchet insert into a recess of an end cap of the elongated barrel, and then places the second end the ratchet insert into a ratchet clutch where the ratchet clutch is also connected to a handle. The user then inserts a first end of a second ratchet insert into a recess of the other end cap of the elongated barrel, and then places the second end of the second ratchet insert into a second ratchet clutch where the second ratchet clutch is connected to a second handle. Next, the user inserts a portion of an inflatable into a slot in the elongated barrel wherein the slot has a length shorter than the length of the elongated barrel, and places the shifters of each of the ratchet clutches in an initial position. The user then pulls the first handle towards the user, pushes the first handle away from the user, pulls the second handle towards the user, pushes the second handle away from the user, and alternatively repeats the pushing and pulling of the handles to incrementally wind said inflatable around said elongated barrel. In using the device, the portion of the inflatable can either be inserted into the slot directly or via an opening in either of the end caps.

Another object of the present invention is to provide a method for deploying an inflatable wound around an elongated barrel. To deploy the inflatable, the user first inserts a first end of a ratchet insert into a recess of an end cap of the elongated barrel, and then places the second end of the ratchet insert into a ratchet clutch where the ratchet clutch is attached to a handle. The user then inserts a first end of a second ratchet insert into a recess of the other end cap of the elongated barrel, and then places the second end of the second ratchet into a second ratchet clutch where the second ratchet clutch is connected to a second handle. Next, the user places the shifters of each of the ratchet clutches in an alternate position. The user then pulls the handles towards the user while the user walks away from the elongated barrel so that the inflatable unwinds from the elongated barrel.

Additional aspects will become readily more apparent from the detailed description, particularly when taken together with the appended drawings.

BRIEF DESCRIPTION OF THE DRAWINGS

For a further understanding of the nature and objects of the present invention, reference should be had to the following description taken in conjunction with the accompanying drawings in which like parts are given like reference numerals.

FIG. 1 illustrates an elevational view of an exemplary embodiment of the invention as it appears before collection of an inflatable.

FIG. 2 illustrates an elevational view of the elongated barrel of the invention.

Figure 3:
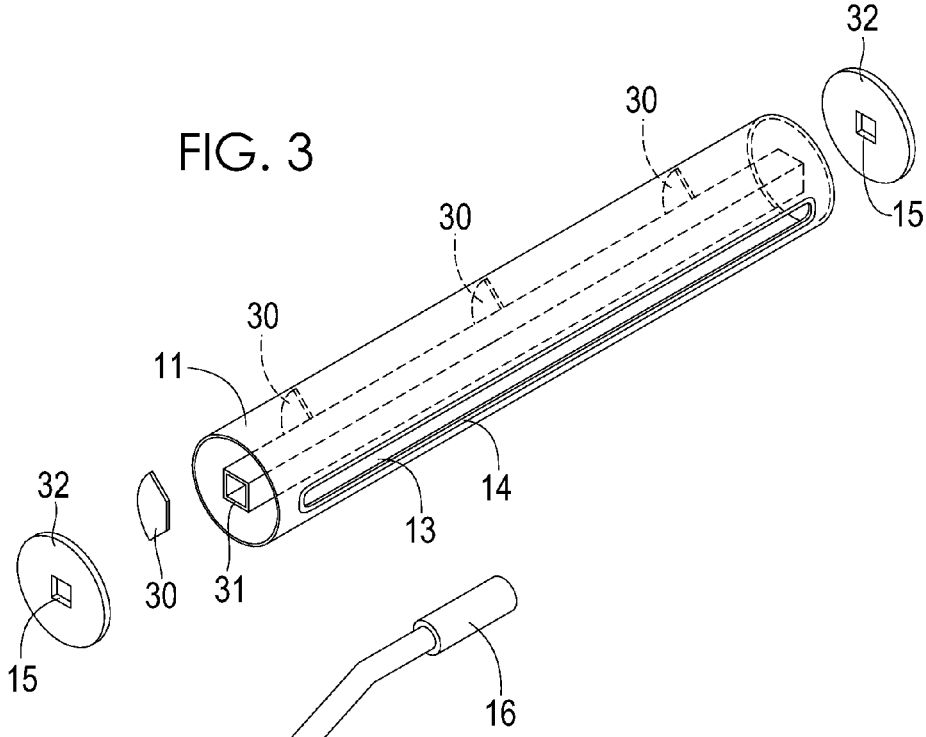
FIG. 3 illustrates an exploded view of the elongated barrel of the invention.

The images in the drawings are simplified for illustrative purposes and are not depicted to scale. Within the descriptions of the figures, similar elements are provided similar names and reference numerals as those of the previous figure (s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION OF THE INVENTION

Turning now to the figures, FIG. 1 illustrates an exemplary embodiment of the device 10 for collecting and deploying inflatables 28. For the purpose of this application the term inflatable 28 includes without limitation inflatable objects, tents, tarps, signs, awnings, and other similar objects. The device 10 is shown as it would appear immediately before collection of the inflatable 28 would commence. The device 10 includes an elongated barrel 11. The elongated barrel 11 includes a slot 13 that runs along a portion of the length of the elongated barrel 11, and where the length of the slot 13 is shorter than the length of the elongated barrel 11. The slot 13 allows for a portion of the inflatable 28 to be inserted into the slot 13 and at least partially into the interior of the elongated barrel 11. At each end of the elongated barrel 11 are end caps 32. Each end cap 32 is solid with a recess 15. Additionally, removably connected to each end cap 32 is a ratchet device 29. Connected to each ratchet device 29 is a handle 12.

FIG. 2 depicts the elongated barrel 11 without the ratchet devices 29 or handles 12 connected. As can be seen in FIGS. 2 and 3, the elongated barrel 11 is hollow, and inside of the elongated barrel 11 a length of tubing 31 runs parallel to an axial length of, and is the same length as, the elongated barrel 11. The tubing 31 is square in circumference. In the exemplary embodiment, as shown in FIG. 2, the recesses 15 of the end caps 32 are square shaped to match the square tubing 31 running inside the elongated barrel 11. However, in alternative embodiments the tubing 31 and end caps 32 may be rectangular, circular, or may take another shape.

Figure 13:
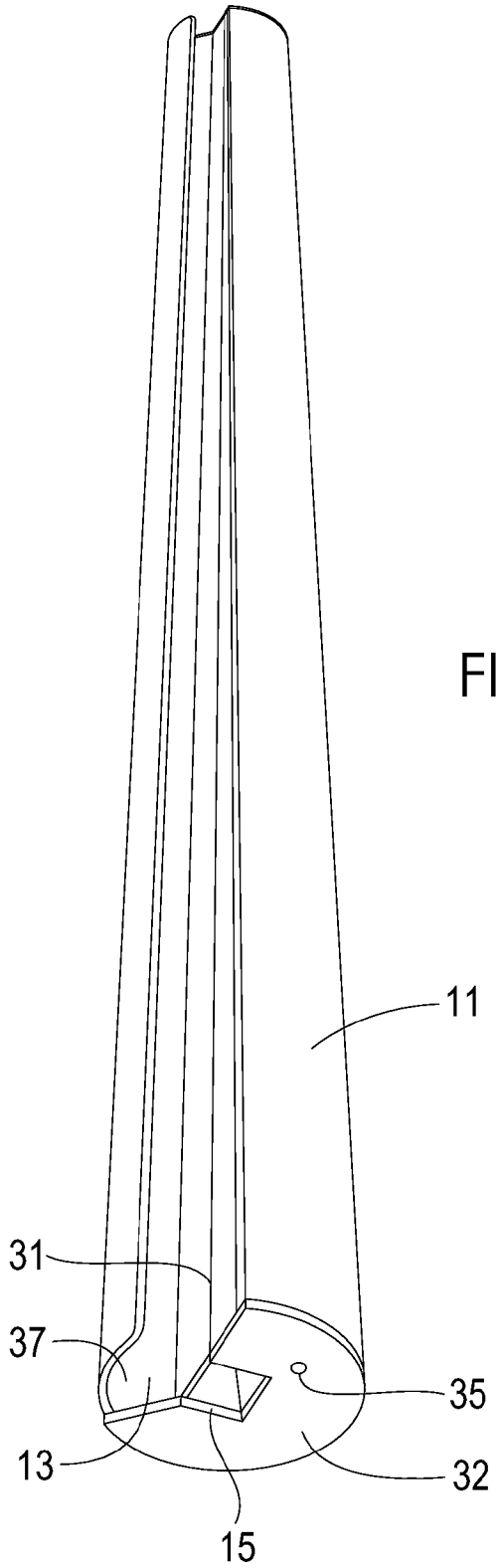
FIG. 13 illustrates an exemplary embodiment of the invention with the slot extending to the outer edges of the elongated barrel and including an opening in the end caps.

FIG. 13 illustrates an alternate embodiment of the device 10 where the slot 13 extends to the outer edges of the end caps 32. Additionally, in this embodiment the end caps 32 are not fully circular in shape, rather the end caps 32 include an opening 37. An end cap 32 with an opening 37 takes the form of a partial disc with an outer circumferential arc length of at least 180°. This embodiment allows the user to slide a portion of the inflatable 28 into the slot 13 through the opening 37 of either end cap 32.

In order to provide structural integrity, in one embodiment the end caps 32 are immediately adjacent to and secured to the elongated barrel 11. Additionally, each end of the tubing 31 is attached to each of the end caps 32. The end caps 32 and the tubing 31 can be attached by welding, screws, adhesive, or any other known attachment method. Furthermore, as can be seen in FIG. 3, inside the elongated barrel 11 are multiple baffles 30 that provide additional stability. The baffles 30 are placed perpendicular to the axes of the tubing 31 and elongated barrel 11, and are placed on the opposite side of the elongated barrel 11 from the slot 13. Placement of the baffles 30 opposite from the slot 13 allows a user to insert a portion of the inflatable 28 through the slot 13 and into the area between the tubing 31 and the elongated barrel 11. The baffles 30 extend from the exterior of the tubing 31 outwardly to the elongated barrel 11, and are substantially quarter circle in shape. An exemplary embodiment of the device 10 uses three baffles 30 that are evenly spaced along the length of the tubing 31. However, more baffles 30 may be used if additional support is desired. Also, fewer or no baffles 30 may be used if less or no additional support is required.

Figure 9:
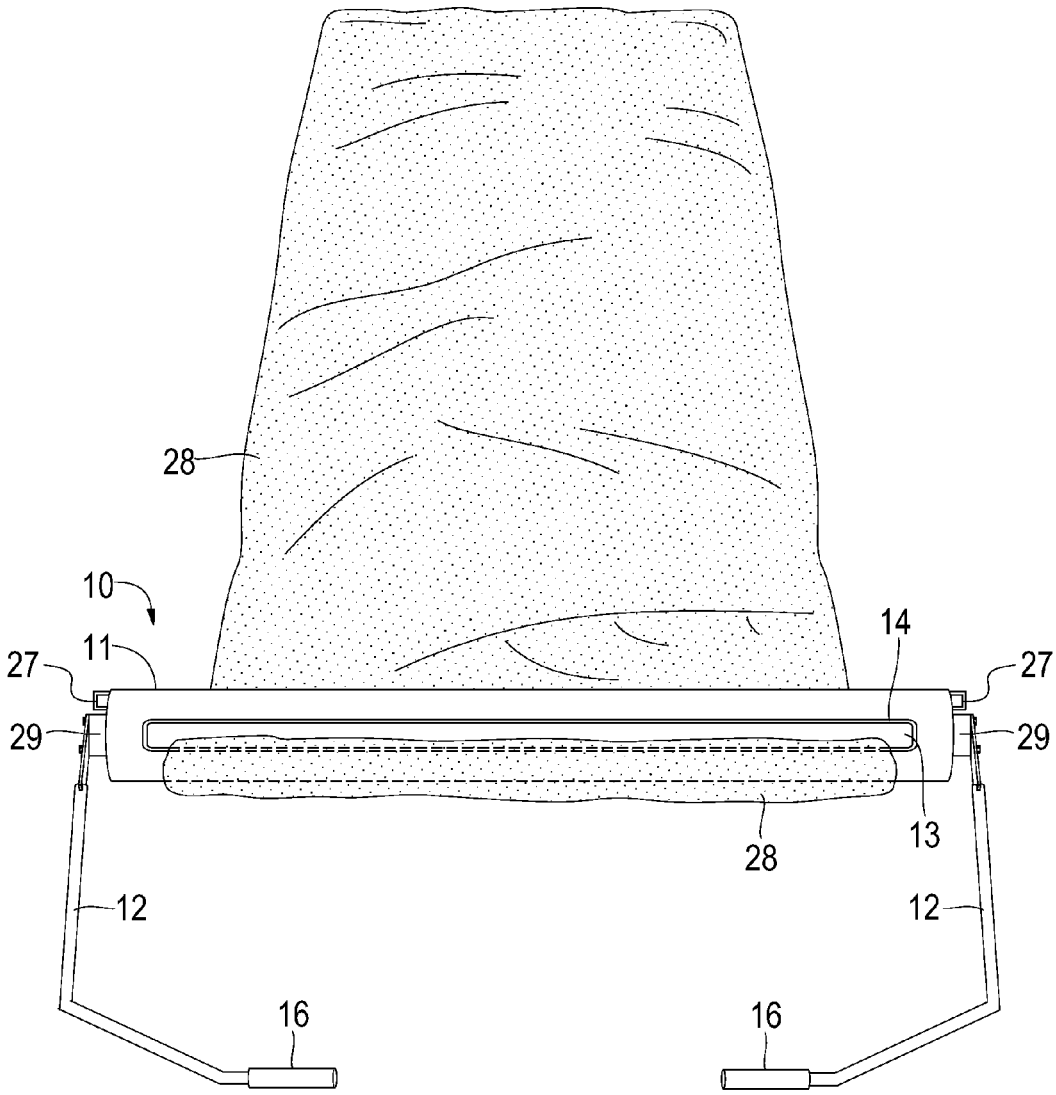
FIG. 9 illustrates an elevational view of the invention with the inflatable partially collected.
Figure 10:
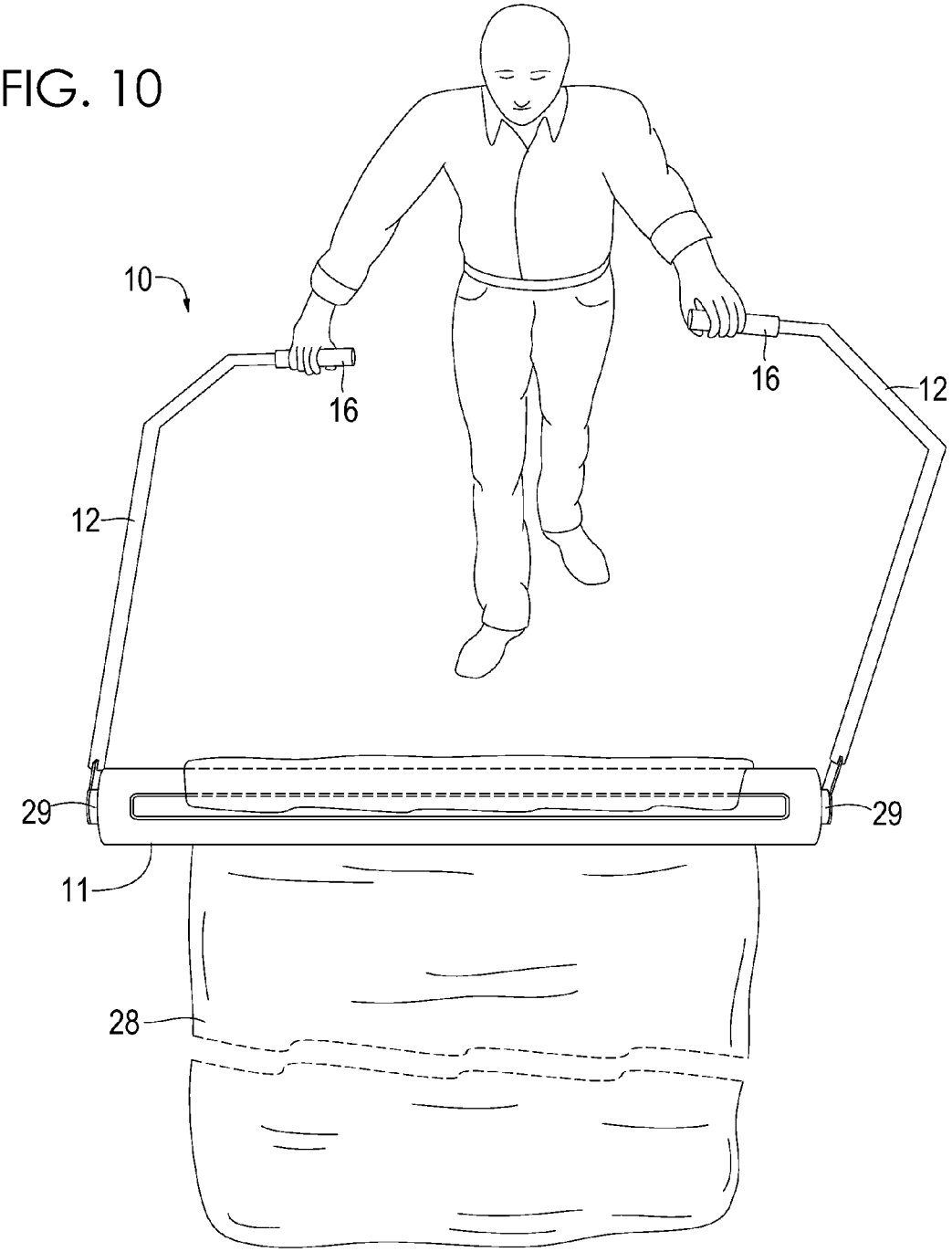
FIG. 10 illustrates the use of the device to collect an inflatable.
Figure 11:
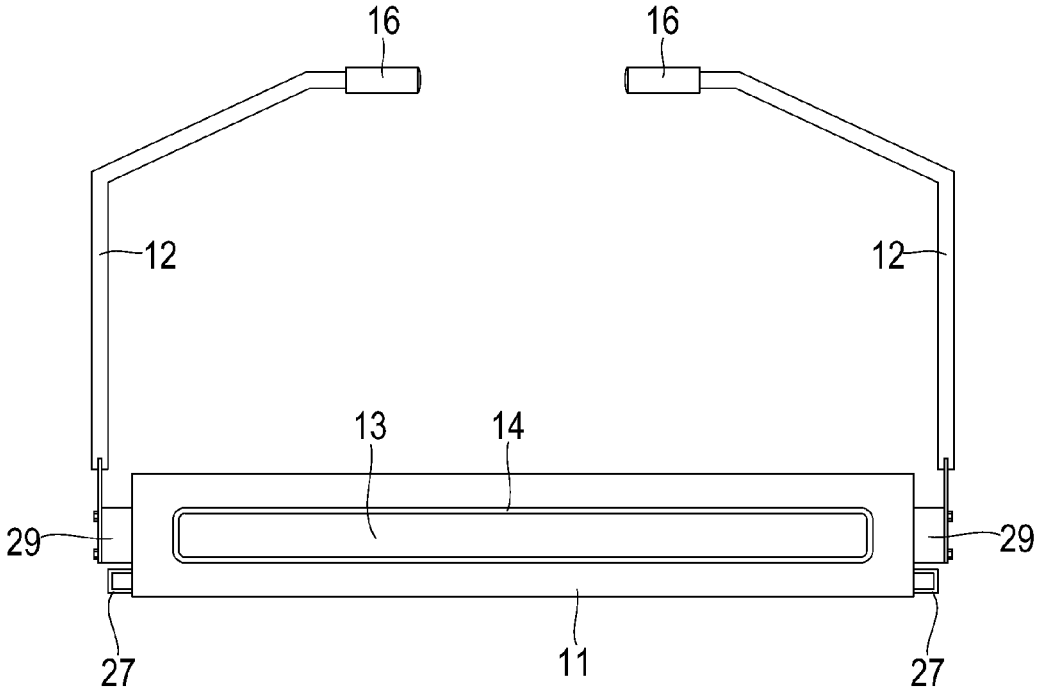
FIG. 11 illustrates an embodiment of the invention including lifting hooks.

As previously mentioned, inflatables 28 are often very heavy. When the inflatable 28 is collected using the device 10, and therefore is wrapped around the elongated barrel 11, the hollow nature of the tubing 31 will allow a fork of a forklift to be inserted inside the tubing 31 of the elongated barrel 11. Once the fork is inserted inside the tubing 31, the forklift can lift and move the inflatable 28. In an alternate embodiment, the device 10 may include lifting hooks 27 on each end cap 32 of the elongated barrel 11 as shown in FIG. 9. The lifting hooks 27 allow the collected inflatable 28 to be lifted and/or moved by use of a handle, hoist, crane, or other lifting device. In another embodiment, as shown in FIG. 13, the end caps 32 may include a hole 35 that, similarly to the lifting hooks 27, will allow the collected inflatable 28 to be more easily lifted and moved. The structural support provided by the end caps 32 and the baffles 30 allows the collected inflatable 28 to be moved by the forklift, handle, hoist, crane or other lifting device without deforming the elongated barrel 11.

Also, as shown in FIGS. 1 and 2, in the exemplary embodiment the slot 13 of the elongated barrel 11 is bordered with a rim 14, where the rim 14 is made of rubber, vinyl, or similar material to prevent any damage to the inflatable 28. In the exemplary embodiment, the rim 14 is made of rubber, and protects the inflatable 28 from tearing or ripping.

Figure 4:
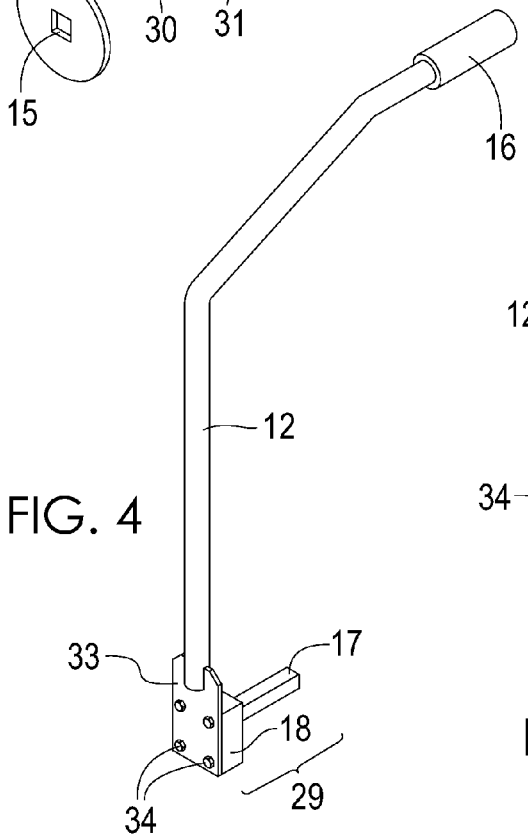
FIG. 4 illustrates an elevational view of the handle and ratchet device of the invention.

FIG. 4 depicts a ratchet device 29 and a handle 12 of the device 10. In the exemplary device 10, each handle 12 is made up of a J-shaped hollow pipe with a gripping portion 16 near the end of the pipe distal from the ratchet device 29. In an alternative embodiment, the handles 12 may be shaped differently, with additional or fewer bends, to minimize the user's effort. As can also be seen in FIG. 4, the handles 12 include a gripping portion 16 that allows the user to maintain better control and grip of the device. The gripping portion 16 may be made of rubber, foam or a similar material.

Figure 5:
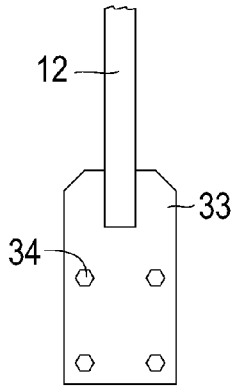
FIG. 5 illustrates an elevational view of the flange.
Figure 5A:
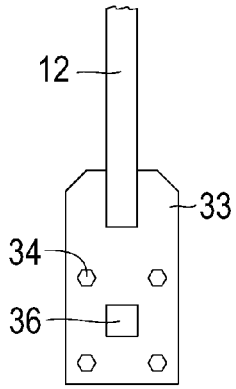
FIG. 5*a* illustrates an elevational view of the flange including a window.
Figure 6:
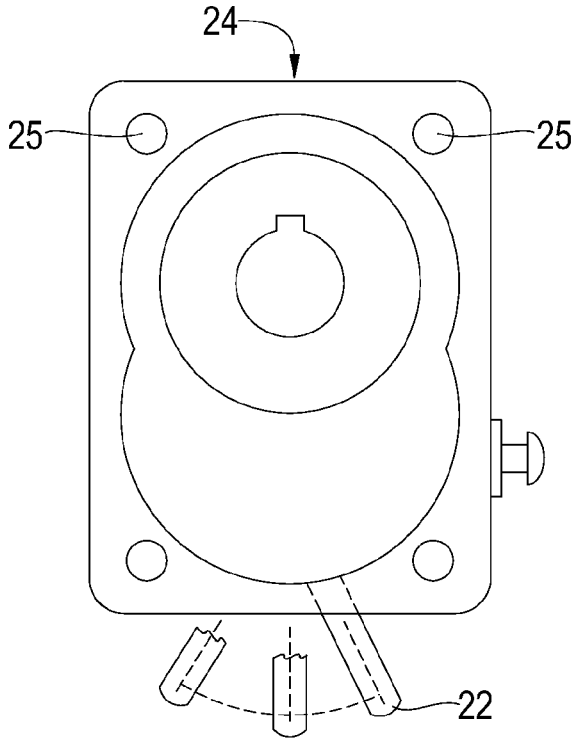
FIG. 6 illustrates an exterior view of the ratchet clutch.

As can be seen in FIGS. 4, 5 and 5*a*, at the opposite end of the handle 12 from the gripping portion 16 is a flange 33. The flange 33 allows the handle to be connected to the ratchet device 29 using bolts 34 or other attachment means. Each ratchet device 29 comprises a ratchet clutch 18 and a ratchet insert 17.

Figure 7:
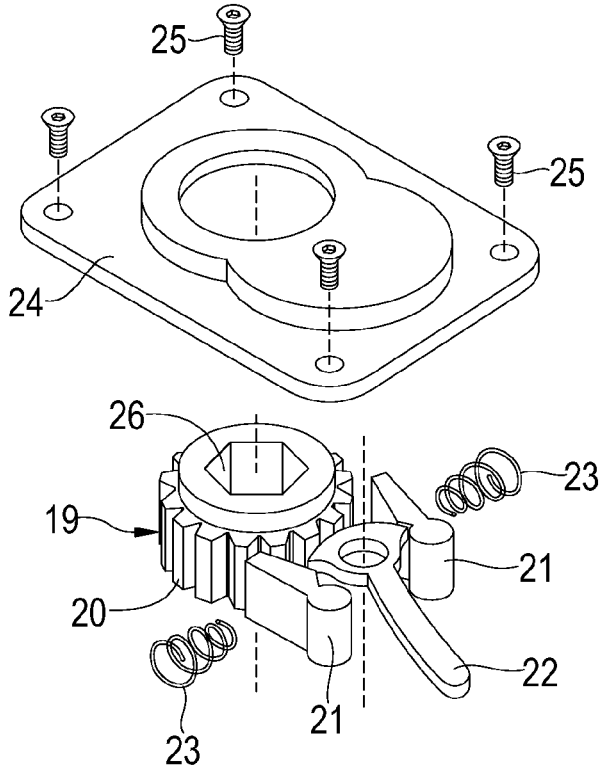
FIG. 7 illustrates an exploded view of the interior of the ratchet clutch.

As shown in FIG. 7, the ratchet clutch 18 comprises a gear 19 comprising a plurality of teeth 20 along its outer periphery, two pawls 21, two pawl springs 23, a shifter 22 and a ratchet housing 24. Each pawl 21 is contained within and attached to the ratchet housing 24 such that each pawl spring 23 is capable of engaging with each pawl 21 and further capable of forcing each pawl 21 to engage with the teeth 20 of the gear 19. The shifter 22 has three positions, an initial position, a neutral position and an alternate position. When the shifter 22 is in an initial position, it results in only one of the pawls 21 engaging the teeth 20 of the gear 19. When the shifter 22 is in the alternate position, it results in only the other pawl 21 engaging the teeth 20 of the gear 19. When the shifter 22 is in the neutral position, it results in neither pawl being engaged with the teeth 20 of the gear 19. When a pawl 21 is engaged with the teeth 20 of the gear 19, the pawl 21 passes over the teeth 20 of the gear 19 as the gear 19 rotates in a forward direction, but cannot pass over the teeth 20 of the gear 19 if the gear 19 is rotated in the opposite direction. The ratchet housing 24 is held together using at least one housing screw 25.

The gear 19 is contained within the ratchet housing 24 so that it is able to rotate. In the center of the gear 19 is a socket 26. One end of the ratchet insert 17 is placed into the socket 26. The ratchet insert 17 may further be secured to the socket 26 by welding. Alternatively, the ratchet insert 17 may be secured inside of the socket 26 using bolts, screws or any other form of attachment. The opposite end of the ratchet insert 17 is placed into the recess 15 of the elongated barrel 11 to removably connect the ratchet device 29 to the elongated barrel 11. Furthermore, in the exemplary embodiment, the ratchet insert 17 is inserted into the recess 15 of the elongated barrel 11 so that the ratchet insert 17 and attached handle 12 are easily removable from the elongated barrel 11.

Figure 12:
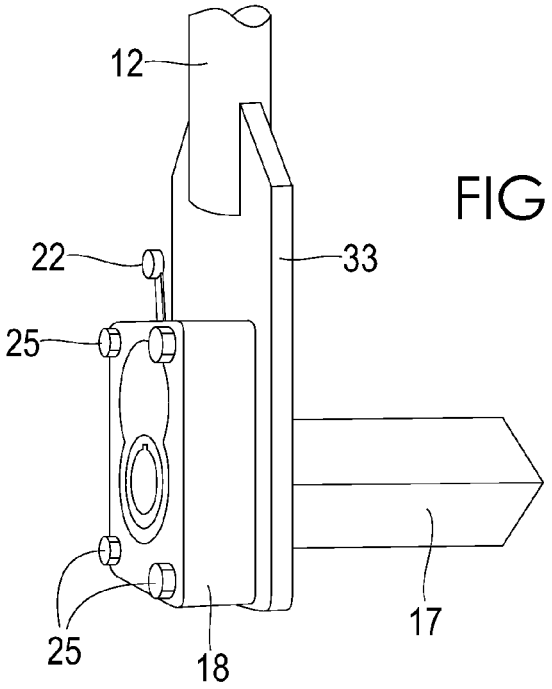
FIG. 12 illustrates an embodiment of the invention with the ratchet clutch on the outer side of the flange.

As shown in FIG. 4, the ratchet clutch 18 is secured to the interior side of the flange 33. The ratchet clutch 18 may be attached to the flange using bolts 34 or various other methods, including using screws or permanently welding the elements together. In an alternative embodiment, as shown in FIG. 12, the ratchet clutch 18 is attached to the outer side of the flange 33. In this embodiment, the flange 33 includes a window 36 in the flange 33, as shown in FIG. 5*a*, to allow the ratchet insert 17 to pass through the flange 33 and into the socket 26 of the ratchet clutch 18. The ratchet clutch 18 may be attached to the flange 33 using the housing screws 25 of the ratchet clutch 18, using additional bolts, or other similar methods.

As can be appreciated, the length of the elongated barrel 11 and the length of the handles 12 may vary in size as to accommodate various sizes of inflatables. Furthermore, the elements of the device may be made of a variety of materials, including aluminum, steel, galvanized steel, or a plastic such as polyethylene, as long as the materials provide sufficient structural integrity to the device. In one embodiment, the elongated tube 11 is made of polyethylene and the remaining elements are made of aluminum to provide a structurally stable but lighter weight design. When a plastic such as polyethylene is used for the elongated tube 11 of the device 10, it may be required to use a method other than welding to attach the end caps 32 to the elongated tube 11, such as using bolts, adhesive or another method known to those skilled in the art.

Another aspect of the invention is a method of using the device 10 to collect an inflatable 28 that has been substantially or completely deflated as shown in FIGS. 9 *and* 10. The method comprises first inserting the ratchet insert 17 into the recess 15 of each end cap 32 of the elongated barrel 11 thereby attaching the handles 12 and ratcheting device 29 to the elongated barrel 11.

Next, a portion of the inflatable 28 is inserted into the slot 13 of the device 10. The inflatable 28 may be inserted either directly into the slot 13 or into the slot 13 through an opening 37 of either end cap 32. The portion of the inflatable 28 inserted into the slot 13 will reside between the outside of the tubing 31 and the inside of the elongated barrel 11. Inserting the portion of the inflatable 28 through the slot 13 allows the device 10 to engage with the inflatable 28 so the inflatable 28 can be wound, or incrementally gathered, around the elongated barrel 11 wherein the elongated barrel 11 further supports the inflatable 28.

Figure 8:
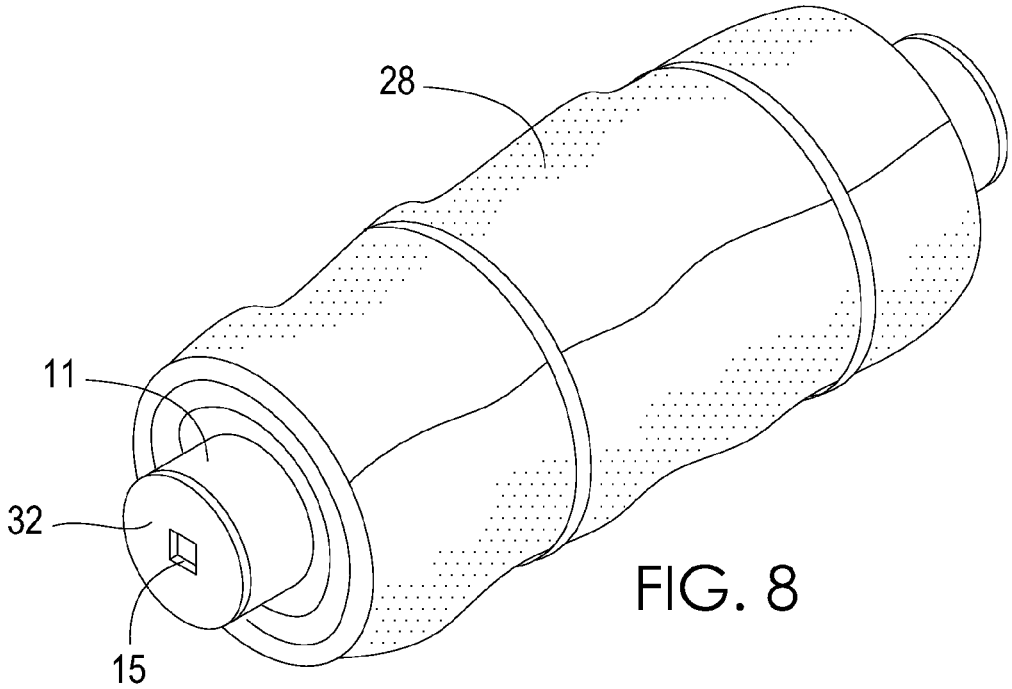
FIG. 8 illustrates an elevational view of the invention after collection of an inflatable and prior to deployment.

With the shifter 22 in the initial position, the user pulls one of the handles 12 towards the user to engage and operate the device 10. When the handle 12 is pulled towards the user, the force rotates the socket 26 and the gear 19. When the socket 26 and gear 19 rotate, it allows the pawl 21 to pass over the teeth 20 of the gear 19. The user then pushes the same handle 12 away from the user. When the user pushes the handle 12 away, the pawl 21 engages with the teeth 20 of the gear 19 so that pawl 21 cannot pass over the teeth 20. Thus, when the handle 12 is pushed away, it forces the elongated barrel 11 to roll forward over the inflatable 28. The user then pulls the other handle 12 towards the user to repeat the method on the other side of the device 10. As the user alternatively pulls and pushes the handles 12, the elongated barrel 11 is forced to roll over the extended inflatable 28 and incrementally winds or gathers the inflatable 28 around the elongated barrel 11. Additionally, the incremental winding or gathering of the inflatable 28 around the elongated barrel 11 forces out much of the excess water from inside and on the inflatable 28. After the inflatable 28 is substantially wound around the barrel 11, the user removes the handles 12 and ratchet devices 29 by removing the ratchet inserts 17 from of the recesses 15 of the elongated barrel 11. As shown in FIG. 8, the inflatable 28 is wound around the elongated barrel 11 and is ready for storage.

To deploy the inflatable 28, the user connects the handles 12 and ratchet devices 29 to the elongated barrel 11 by placing the ratchet inserts 17 into the recesses 15 of the end caps 32. The user then places the shifter 22 in the alternate position, and pulls the device 10 towards the user. As the user pulls the device 10, the inflatable 28 will unroll from the elongated barrel 11. The user will then continue to walk with the device 10, and further unroll the inflatable 28 until completely unwound from the elongated barrel 11.

The foregoing description of the embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof as permitted as a matter of law.

That which is claimed is:

1. A collection and deployment device comprising:

an elongated barrel having a length, a first end, a second end, and a slot having a length;

a first end cap immediately adjacent to said first end of said elongated barrel;

a second end cap immediately adjacent to said second end of said elongated barrel;

a first ratchet device removably connected to said first end cap;

a second ratchet device removably connected to said second end cap;

a first handle connected to said first ratchet device; and a second handle connected to said second ratchet device;

wherein said length of said slot is shorter than said length of said elongated barrel;

wherein said first and second ratchet devices each comprise a ratchet clutch and a ratchet insert; and wherein said ratchet inserts each have a first end and a second end; and wherein said ratchet clutches of said first and second ratchet devices each respectively comprise:

a ratchet housing;

a gear disposed within said ratchet housing and comprising a plurality of teeth where said gear further comprises a socket;

a first pawl and a second pawl disposed within said ratchet housing wherein said first and second pawls are capable of engaging with said plurality of teeth of said gear;

a first pawl spring and a second pawl spring disposed within said ratchet housing wherein said first pawl spring engages with said first pawl and said second pawl spring engages with said second pawl; and a shifter capable of engaging with said first pawl or said second pawl.

2. The device according to claim 1, wherein said slot comprises a rim.

3. The device according to claim 2, wherein said rim is made of rubber.

4. The device according to claim 1, wherein said first and second end caps comprise a first recess and a second recess, respectively.

5. The device according to claim 4, wherein said first and second end caps each further comprise a lifting hook.

6. The device according to claim 4, wherein said first and second end caps each further comprise a hole.

7. The device according to claim 4, further comprising a length of a tubing having a first end and a second end; wherein said tubing is located inside said elongated barrel and is in parallel with an axial length of said elongated barrel.

8. The device according to claim 7, wherein said tubing is square in circumference.

9. The device according to claim 7, wherein said first end of said tubing is secured to said first end cap; and said second end of said tubing is secured to said second end cap.

10. The device according to claim 9 further comprising at least one baffle located inside said elongated barrel.

11. The device of claim 1 further comprising at least one housing screw.

12. The device of claim 1 wherein said first end of said ratchet insert of said first ratchet device is placed into said socket of said ratchet clutch of said first ratchet device and wherein said second end of said ratchet insert of said first ratchet device is placed into said first recess to removably connect said ratchet clutch of said first ratchet device to said elongated barrel; and wherein said first end of said ratchet insert of said second ratchet device is placed into said socket of said ratchet clutch of said second ratchet device and wherein said second end of said ratchet insert of said second ratchet device is placed into said second recess to removably connect said ratchet clutch of said second ratchet device to said elongated barrel.

13. The device of claim 12 wherein a first flange is connected to said first handle and is also connected to said ratchet clutch of said first ratchet device; and a second flange is connected to said second handle and is also connected to said ratchet clutch of said second ratchet device.

14. The device of claim 13 wherein said first and second flanges are connected to said ratchet clutches of said first and second ratchet devices, respectively, using bolts.

15. The device of claim 14 wherein said first and second flanges each comprise a window.

16. The device of claim 15 wherein each respective said window allows said ratchet inserts of said first and second ratchet devices to pass through said first and second flanges, respectively, and into said sockets of said ratchet clutches of said first and second ratchet devices, respectively.

17. A collection and deployment device comprising:

an elongated barrel having a length, a first end, a second end, and a slot having a length;

a first end cap immediately adjacent to said first end of said elongated barrel;

a second end cap immediately adjacent to said second end of said elongated barrel;

a first ratchet device removably connected to said first end cap;

a second ratchet device removably connected to said second end cap;

a first handle connected to said first ratchet device; and a second handle connected to said second ratchet device;

wherein said length of said slot is shorter than said length of said elongated barrel; and wherein said first and second handles each comprise a gripping portion.

18. A collection and deployment device comprising:

an elongated barrel having a length, a first end, a second end, and a slot having a length;

a first end cap immediately adjacent to said first end of said elongated barrel;

a second end cap immediately adjacent to said second end of said elongated barrel;

a first ratchet device removably connected to said first end cap;

a second ratchet device removably connected to said second end cap;

a first handle connected to said first ratchet device; and a second handle connected to said second ratchet device;

wherein said length of said slot is at least as long as said length of said elongated barrel wherein said first and second ratchet devices each comprise a ratchet clutch and a ratchet insert; and wherein said ratchet inserts each have a first end and a second end; and wherein said ratchet clutches of said first and second ratchet devices each respectively comprise:

a ratchet housing;

a gear disposed within said ratchet housing and comprising a plurality of teeth where said gear further comprises a socket;

a first pawl and a second pawl disposed within said ratchet housing wherein said first and second pawls are capable of engaging with said plurality of teeth of said gear;

a first pawl spring and a second pawl spring disposed within said ratchet housing wherein said first pawl spring engages with said first pawl and said second pawl spring engages with said second pawl; and a shifter capable of engaging with said first pawl or said second pawl.

19. The device according to claim 18, wherein said slot comprises a rim.

20. The device according to claim 19, wherein said rim is made of rubber.

21. The device according to claim 18, wherein said first and second end caps comprise a first recess and a second recess, respectively.

22. The device according to claim 21, wherein said first and second end caps additionally comprise a first opening and a second opening, respectively.

23. The device according to claim 22, wherein said first and second end caps comprise a partial disc with an outer circumferential arc length of at least 180°.

24. The device according to claim 22, wherein said first and second end caps each further comprise a lifting hook.

25. The device according to claim 22, wherein said first and second end caps each further comprise a hole.

26. The device according to claim 22, further comprising a length of a tubing having a first end and a second end; wherein said tubing is located inside said elongated barrel and is parallel with an axial length of said elongated barrel.

27. The device according to claim 26, wherein said tubing is square in circumference.

28. The device according to claim 26, wherein said first end of said tubing is secured to said first end cap; and said second end of said tubing is secured to said second end cap.

29. The device according to claim 28 further comprising at least one baffle located inside said elongated barrel.

30. The device of claim 18 further comprising at least one housing screw.

31. The device of claim 18 wherein said first end of said ratchet insert of said first ratchet device is placed into said socket of said ratchet clutch of said first ratchet device and wherein said second end of said ratchet insert of said first ratchet device is placed into said first recess to removably connect said ratchet clutch of said first ratchet device to said elongated barrel; and wherein said first end of said ratchet insert of said second ratchet device is placed into said socket of said ratchet clutch of said second ratchet device and wherein said second end of said ratchet insert of said second ratchet device is placed into said second recess to removably connect said ratchet clutch of said second ratchet device to said elongated barrel.

32. The device of claim 31 wherein a first flange is connected to said first handle and is also connected to said ratchet clutch of said first ratchet device; and a second flange is connected to said second handle and is also connected to said ratchet clutch of said second ratchet device.

33. The device of claim 32 wherein said first and second flanges are connected to said ratchet clutches of said first and second ratchet devices, respectively, using bolts.

34. The device of claim 32 wherein said first and second flanges each comprise a window.

35. The device of claim 34 wherein each respective said window allows said ratchet inserts of said first and second ratchet devices to pass through said first and second flanges, respectively, and into said sockets of said ratchet devices of said first and second ratchet clutches, respectively.

36. The device of claim 18 wherein said first and second handles each comprise a gripping portion.

* * * * *